US006349189B1

(12) United States Patent
Jeon

(10) Patent No.: US 6,349,189 B1
(45) Date of Patent: Feb. 19, 2002

(54) HOPPER-INTEGRATED TYPE DEVELOPING UNIT FOR IMAGE FORMING APPARATUS

(75) Inventor: Nam-Gon Jeon, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/657,229

(22) Filed: Sep. 7, 2000

(30) Foreign Application Priority Data

Oct. 1, 1999 (KR) ..... 99/42198

(51) Int. Cl.[7] ..... G03G 15/04
(52) U.S. Cl. ..... 399/119
(58) Field of Search ..... 399/110, 111, 399/119, 117, 272, 281

(56) References Cited

U.S. PATENT DOCUMENTS 5,848,336 A * 12/1998 Hazama et al. ..... 399/222
5,923,931 A * 7/1999 Kishimoto ..... 399/256

* cited by examiner

*Primary Examiner*—Quana M. Grainger
(74) *Attorney, Agent, or Firm*—Robert E. Bushnell, Esq.

(57) ABSTRACT

A hopper-integrated type developing unit for image forming apparatus is disclosed. The unit comprises a case, a supply roller, a developing roller, a photosensitive drum, a supply roller retaining shaft, a developing roller retaining shaft, two photosensitive drum retaining shafts, driving gears and removal restricting means. The case consists of a body and side plates. The supply roller, the developing roller and the photosensitive roller are accommodated in the case. The supply roller retaining shaft pierces the supply roller and is rotatably held by the side plates of the case at its both ends. The developing roller retaining shaft pierces the developing roller and is rotatably held by the side plates of the case at its both ends. Two photosensitive drum retaining shafts are respectively fixed to side plates at its inner ends and respectively inserted into an interior of the photosensitive drum at its outer ends. The driving gears are respectively fitted around the retaining shafts. The removal restricting means allows the supply roller retaining shaft and the developing roller retaining shaft to be combined with and removed from the side plate of the case only at one engagement state of the driving gears.

13 Claims, 3 Drawing Sheets

HOPPER-INTEGRATED TYPE DEVELOPING UNIT FOR IMAGE FORMING APPARATUS

CLAIM OF PRIORITY

This application makes reference to, incorporates the same herein, and claims all benefits accruing under 35 U.S.C. §119 from my application THE DEVELOPER INTEGRATED WITH HOPPER OF IMAGE FORMING APPARATUS filed with the Korean Industrial Property Office on Oct. 1, 1999 and there duly assigned Serial No.42198/1999.

BACKGROUND OF THE INVENTION

1. Field of the Invention

The present invention relates, in general, to a developing unit for an image forming apparatus. More particularly, it relates to a hopper-integrated developing unit for an image forming apparatus.

2. Description of the Related Art

A conventional developing unit, to which a developing roller, and a photosensitive drum, a hopper containing toner are mounted, is installed in a laser printer or copying machine.

Such a developing unit may be classified into a recycling type unit or a non-recycling type unit. The recycling type developing unit can be reused with an old hopper replaced with a new hopper, because its hopper containing toner may be removed. On the other hand, a non-recycling type developing unit must have its entire developing unit replaced with a new one after the consumption of toner because the hopper is integrated with the remaining portions of the developing unit. Therefore, when toner is consumed the conventional hopper-integrated developing unit must be replaced with a new developing unit.

Nevertheless, some reproduction companies provide at a low price reproduced developing units that are filled with toner while their old photosensitive drums, developing rollers and supply rollers are not replaced with new parts. These inferior reproduced developing units not only do harm to the image of a genuine developing unit manufacture, but also cause inconvenience to the users of the developing units because of frequent breakdowns.

To solve this problem, proposals have been made for mounting screws to be rotatable for assembly and to be non-rotatable for disassembly so as to prevent a supply roller, a developing roller and a photosensitive drum from being removed from a case, or side plates are assembled with the case using an ultrasonic or thermal fusion bonding process. However, such proposals create a problem. When a breakdown occurs just after the assembly of the developing unit is completed, the developing unit must be discarded because the side plates cannot be removed from the case.

SUMMARY OF THE INVENTION

Accordingly, an object of the present invention is to provide a hopper-integrated type developing unit for an image forming apparatus, which is capable of preventing the developing unit from being removed from a case for the filling of toner.

Another object of the present invention is to provide a hopper-integrated type developing unit for an image forming apparatus, in which the developing unit can be removed from a case using a jig without damaging when breakdown occurs just after the developing unit is assembled with the case.

In order to accomplish the above object, the present invention provides a hopper-integrated type developing unit for an image forming apparatus, comprising: a case consisting of a body and side plates; a supply roller, a developing roller and a photosensitive roller accommodated in the case; a supply roller retaining shaft around which the supply roller is fixedly fitted and which is rotatably held by the side plates of the case at its both ends; a developing roller retaining shaft around which the developing roller is fixedly fitted and which is rotatably held by the side plates of the case at its both ends; two photosensitive drum retaining shafts respectively fixed to side plates at its inner ends and respectively inserted into an interior of the photosensitive drum at its outer ends; driving gears being respectively fitted around the retaining shafts and transmitting rotating force to the supply roller, the developing roller and the photosensitive drum while being rotated connectively; and removal restricting means which allows the supply roller retaining shaft and the developing roller retaining shaft to be combined with and removed from the side plates of the case only at one engagement state of the driving gears.

Preferably, the removal restricting means may comprise removal restricting projections respectively formed on one side end portions of the supply roller retaining shaft and the developing roller retaining shaft, and accommodating means for receiving one side ends of the supply roller retaining shaft and the developing roller retaining shaft.

Preferably, the accommodating means may be engaging bosses, which are formed on one of the side plates of the case and respectively have openings having shapes respectively corresponding to the sectional shapes of the supply roller retaining shaft and the developing roller retaining shaft at positions where the removal restricting projections are formed.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
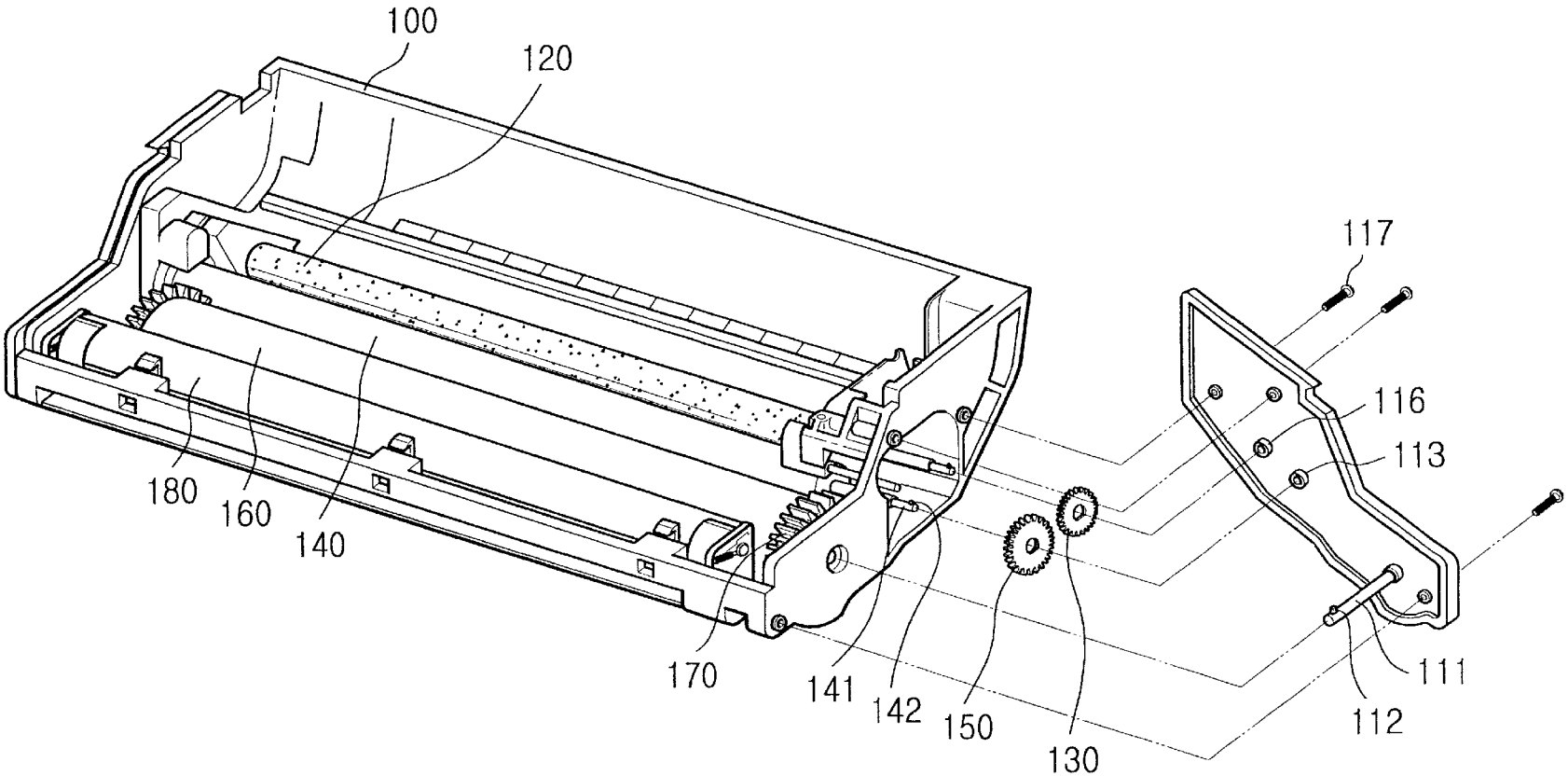
FIG. 1 is a perspective view showing a hopper-integrated type developing unit for an image forming apparatus in accordance with the present invention.

As illustrated in FIG. 1, a hopper-integrated type developing unit for an image forming apparatus according to the present invention comprises a case 100 and a hopper (not shown). Case 100 consists of a body and two side plates 110. The hopper is integrated with case 100 into a single body and contains toner.

A supply roller 120, a developing roller 140, a photosensitive drum 160, and a charging roller 180 are mounted to the interior of case 100. Supply roller 120 supplies the toner contained in the hopper. Developing roller 140 polarizes toner supplied from supply roller 120. Photosensitive drum 160 is in contact with developing roller 140. Charging roller 180 charges photosensitive drum 160. Two side plates 110 for holding supply roller 120, developing roller 140, and photosensitive drum 160 are respectively fixed to both sides of case 100.

Figure 2A:
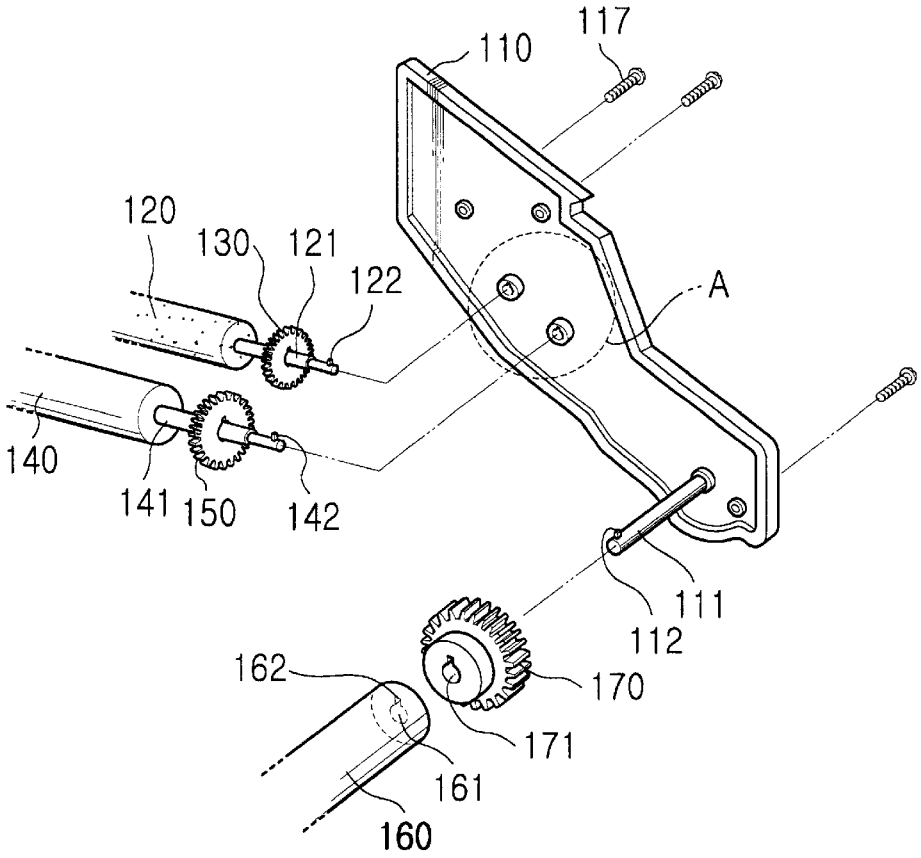
FIG. 2A is an enlarged exploded view of the important parts of the developing unit of the present invention.
Figure 2B:
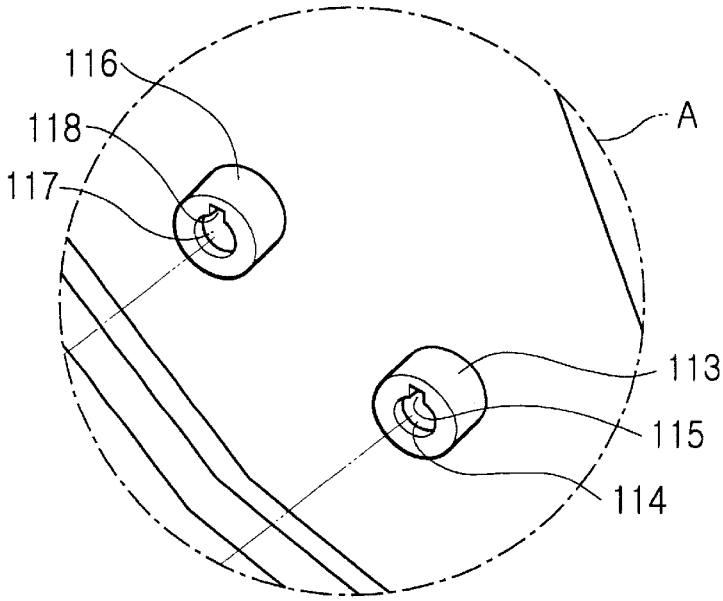
FIG. 2B is an enlarged view of module "A" of FIG. 2A.
Figure 3:
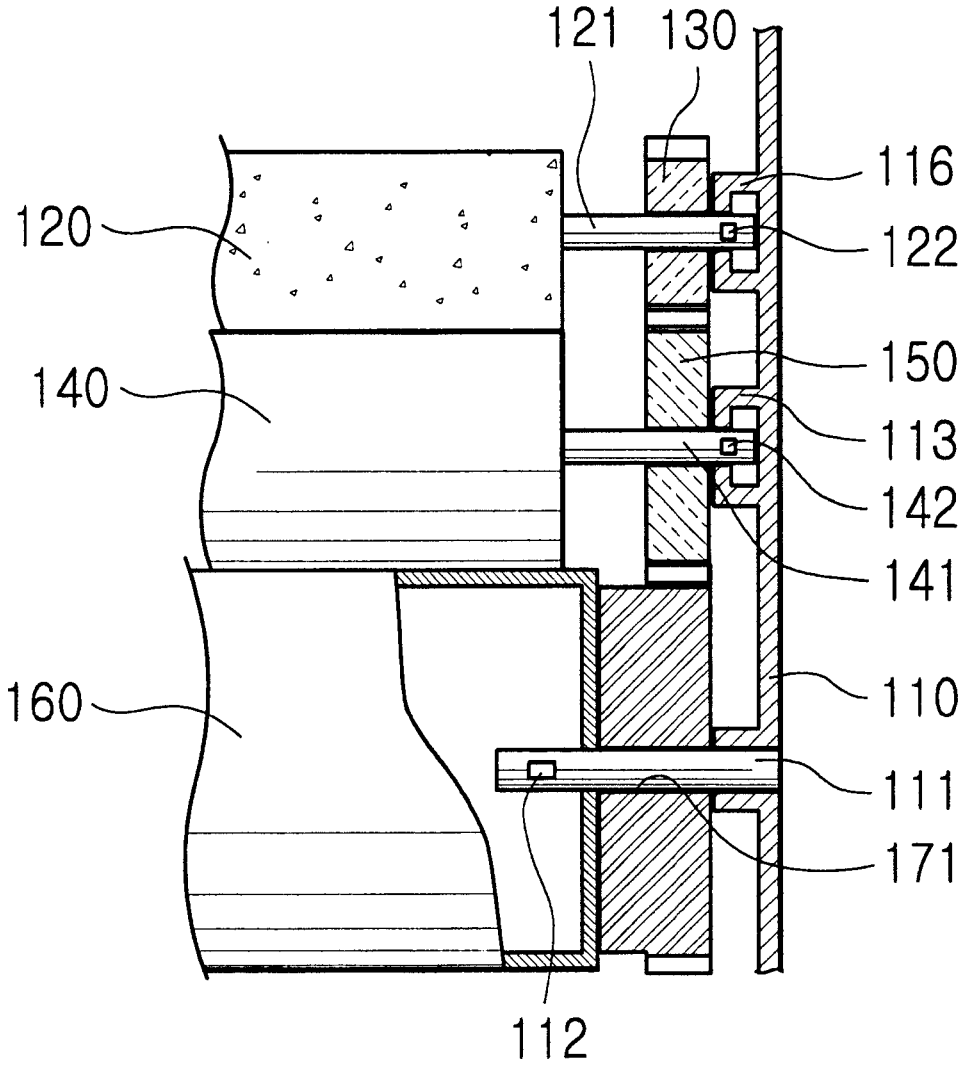
FIG. 3 is an enlarged cross section of parts of the developing unit of the present invention.

Referring to FIGS. 2A, 2B and 3, a supply roller driving gear 130 is attached around a supply roller retaining shaft 121 and piercing supply roller 120. One end of supply roller retaining shaft 121 is rotatably engaged with an engaging boss 116 that is formed on one of side plates 110. A developing roller driving gear 150 is attached around a developing roller retaining shaft 141, piercing developing roller 140. One end of developing roller retaining shaft 141 is rotatably engaged with an engaging boss 113 that is formed on side plate 110. A photosensitive drum driving gear 170 is fixed to one end surface of photosensitive drum 160, and is rotatably fitted around photosensitive drum retaining shaft 111, piercing photosensitive drum 160. One end of photosensitive drum retaining shaft 111 is fixed to side plate 110. The other end of photosensitive drum retaining shaft 111 is inserted into the interior of photosensitive drum 160.

Since supply roller driving gear 130, developing roller driving gear 150, and photosensitive drum driving gear 170 are engaged with one another, supply roller 120, developing roller 140 and photosensitive drum 160 are rotated together.

In accordance with the present invention, removal restricting projections 122, 142, and 112 are respectively formed on the one side end portions of supply roller retaining shaft 121, developing roller shaft 141 and photosensitive drum retaining shaft 111. As removal restricting projections 122, 142, and 112 are respectively formed on the one side end portions of retaining shafts 121, 141, and 111, through holes 123, 143, and 173 corresponding to removal restricting projections 122, 142, and 112 are formed to be connected with the shaft holes of driving gears 130, 150, and 170 on driving gears 130, 150, and 170, so as to receive retaining shafts 121, 141 and 111.

Additionally, through holes 118 and 115, corresponding to removal restricting projections 122 and 142, are formed to be connected with shaft holes 117 and 114 of engaging bosses 116 and 113 on engaging bosses 116 and 113 into which one side ends of supply roller retaining shaft 121 and developing roller retaining shaft 141, so as to receive supply roller retaining shaft 121 and developing roller retaining shaft 141.

A through hole 162 corresponding to removal restricting projection 112 is formed to be connected with shaft hole 161 of the photosensitive drum 160 on the end surface of photosensitive drum 160 into which one side end of photosensitive drum retaining shaft 111 is inserted, so as to receive photosensitive drum retaining shaft 111.

Hereinafter, an assembly method for the developing unit in accordance with the present invention is described.

Driving gears 130, 150, and 170 are respectively and fixedly fitted around retaining shafts 121, 141, and 111. Shaft holes of driving gears 130, 150, and 170 are respectively aligned with the one side ends of retaining shafts 121, 141, and 111, and through holes 123, 143, and 173 which are respectively aligned with removal restricting projection 122 of retaining shaft 121, removal restricting projection 142 of retaining shaft 141, and removal restricting projection 112 of retaining shaft 111.

A supply roller assembly, a developing roller assembly and a photosensitive drum assembly, in which driving gears 130, 150, and 170 are respectively fitted around supply roller 120, developing roller 140, and photosensitive drum 160, are assembled with side plate 110, while driving gears 130, 150, and 170 are engaged with one another. That is, driving gears 130, 150, and 170 are engaged with one another and the one side ends of retaining shafts 121, 141, and 111 are fitted into engaging bosses 116 and 113 and the one side end surface of photosensitive drum 160, while the one side ends of retaining shafts 121, 141, and 111 are respectively aligned with shaft hole 117 of the engaging boss 116, shaft hole 114 of engaging boss 113, and shaft hole 161 of photosensitive drum 160, and removal restricting projection 122 of retaining shaft 121, removal restricting projection 142 of retaining shaft 141 and removal restricting projection 112 of retaining shaft 111 are respectively aligned with through hole 118 of engaging boss 116, through hole 115 of engaging boss 113 and through hole 162 of photosensitive drum 160.

Subsequently, side plate 110 is assembled with case 100 by means of screws 117, and a hopper (not shown) is integrated with case 100 at the top of case 100 by means of an ultrasonic or thermal fusion bonding process.

When the supply roller assembly, the developing roller assembly and the photosensitive drum assembly are assembled with side plates 110, the supply roller assembly, the developing roller assembly and the photosensitive drum assembly can be easily removed from side plates 110 at an early stage because removal restricting projections 122, 142, and 112 are respectively aligned with through holes 118, 115, and 162. On the other hand, after driving gears 130, 150, and 170 are rotated, it is almost impossible to align removal restricting projections 122, 142, and 112 with through holes 118, 115, and 162, respectively. This is because the teeth of supply roller driving gear 130, developing roller driving gear 150 and photosensitive drum driving gear 170 are different in number.

That is, since it is difficult to align removal restricting projections 122, 142, and 112 respectively with through holes 118, 115, and 162 after assembly is completed and driving gears 130, 150, and 170 are rotated, it is difficult to remove side plates 110 from case 100 without causing damage. Thus, the arrangement of gears, projections, and holes provided a removal-restriction means for allowing the supply roller retaining shaft and developing roller retaining shaft to be combined together, and to be removed from, the side plates of the case only at a predetermined engagement state of the driving gears.

Meanwhile, in order to fill an exhausted developing unit with toner, the developing unit should be removed from case 100. For the developing unit of the present invention, a jig is needed to sense the number of rotations corresponding to common multiples of the teeth numbers of supply roller driving gear 130, developing roller driving gear 150 and photosensitive drum driving gear 170. For example, if the number of teeth of supply roller driving gear 130 is 18, the number of teeth of developing roller driving gear 150 is 24, and the number of teeth of photosensitive drum driving gear 170 is 40, the removal restricting projections 122, 142, and 112 can be respectively aligned with through holes 118, 115, and 162 when driving gears 130, 150, and 170 make the number of rotations corresponding to the multiples of the least common multiple of 2,160. Therefore, the jig is needed to sense the number of rotations so as to allow the removal of the developing unit from case 100.

As a result, since in order to fill the exhausted developing unit with toner, reproduction companies must purchase a jig that senses the number of rotations corresponding to common multiples of the teeth numbers of supply roller driving gear 130, developing roller driving gear 150, and photosensitive drum driving gear 170, or else the reproduction company may cause damage to side plates 110 for the removal of the developing unit, there is no economical benefit in recycling the developing unit, thereby preventing the developing unit from being undesirably recycled.

In addition, since the side plates can be removed from the case in a case where a breakdown occurs just after the assembly of the developing unit is completed, it is not necessary to discard the developing unit.

While the invention has been described in connection with specific and preferred embodiments thereof, it is capable of further modifications without departing from the spirit and scope of the invention. This application is intended to cover all variations, uses, or adaptations of the invention, following, in general, the principles of the invention and including such departures from the present disclosure as come within known or customary practice within the art to which the invention pertains, or as are obvious to persons skilled in the art, at the time the departure is made. It should be appreciated that the scope of this invention is not limited to the detailed description of the invention hereinabove, which is intended merely to be illustrative, but rather comprehends the subject matter defined by the following claims.

What is claimed is:

1. In a hopper-integrated developing unit for an image forming apparatus, said unit comprising:

a case comprising a body and side plates;

a supply roller, a developing roller, and a photosensitive roller housed in said case;

a supply roller retaining shaft around which said supply roller is attached, said shaft extending longitudinally from a first end to a second end, said shaft rotatably held by the side plates of said case at said first and second ends;

a developing roller retaining shaft around which said developing roller is attached, said shaft extending longitudinally from a first end to a second end, said shaft rotatably held by the side plates of said case at said first and second ends;

two photosensitive drum retaining shafts, each of said shafts extending longitudinally from a first end to a second end, said shafts respectively fixed to said side plates at said first ends and respectively inserted into an interior of said photosensitive drum at said second ends; and supply roller, developing roller, and drum roller driving gears, said gears respectively fitted around said retaining shafts and thereby transmitting rotating forces to said supply roller, said developing roller, and said photosensitive drum while being rotated together;

the improvement comprising:

a removal-restricting means for allowing said supply roller retaining shaft and said developing roller retaining shaft to be combined with, and to be removed from the side plates of said case only at a predetermined engagement state of said driving gears.

2. In a hopper-integrated developing unit for an image forming apparatus, said unit comprising:

a cage comprising a body and side plates;

a supply roller, a developing roller, and a photosensitive roller housed in said case;

a supply roller retaining shaft around which said supply roller is attached, said shaft extending longitudinally from a first end to a second end, said shaft rotatably held by the side plates of said case at said first and second ends;

a developing roller retaining shaft around which said developing roller is attached, said shaft extending longitudinally from a first end to a second end, said shaft rotatably held by the side plates of said case at said first and second ends;

two photosensitive drum retaining shafts, each of said shafts extending longitudinally from a first end to a second end, said shafts respectively fixed to said side plates at said first ends and respectively inserted into an interior of said photosensitive drum at said second ends; and supply roller, developing roller, and drum roller driving gears, said gears respectively fitted around said retaining shafts and thereby transmitting rotating forces to said supply roller, said developing roller, and said photosensitive drum while being rotated together;

the improvement comprising:

a removal-restricting means for allowing said supply roller retaining shaft and said developing roller retaining shaft to be combined with, and to be removed from the side plates of said case only at a predetermined engagement state of said driving gears;

said removal-restricting means comprising:

removal restricting projections respectively formed on an end portions of said supply roller retaining shaft and on an end portion of said developing roller retaining shaft, and an accommodating means for receiving an end of said supply roller retaining shaft and an end of said developing roller retaining shaft.

3. The unit of claim 2, wherein said accommodating means comprises engaging bosses formed on one of said side plates of said case, said bosses having openings with shapes respectively corresponding to sectional shapes of said supply roller retaining shaft and said developing roller retaining shaft at positions where said removal restricting projections are formed.

4. The unit of claim 2, wherein said removal restricting means further comprises:

an additional removal restricting projection formed on an inner end portion of said photosensitive drum retaining shaft, and an opening being formed on one end surface of said photosensitive drum and said opening having a shape corresponding to a sectional shape of said photosensitive drum retaining shaft at a position where said additional removal restricting projection is formed.

5. The unit of claim 4, wherein through holes corresponding to said removal restricting projections are formed on said driving gears, said through holes communicating with shaft holes of said driving gears in an alignment state of said through holes and said shaft holes.

6. The unit of claim 5, wherein each of said driving gears has a predetermined number of teeth, and the respective numbers of teeth of said driving gears are not identical, thereby causing the development unit to be removable from the case without damage only in a position of a gear rotation cycle that corresponds to a least common multiple of the product of said numbers of teeth and to a multiple of said least common multiple.

7. A jig for use with the unit of claim 6, said jig adapted to sense a number of rotations corresponding to common multiples of the number of teeth of said driving gears.

8. A method of preventing undesirable recycling of a developing unit of an image forming apparatus and undesirable supply of potentially inferior toner, said unit comprising:

a case comprising a body and side plates;

a supply roller, a developing roller, and a photosensitive roller housed in said case;

a supply roller retaining shaft around which said supply roller is attached, said shaft extending longitudinally from a first end to a second end, said shaft rotatably held by the side plates of said case at said first and second ends;

a developing roller retaining shaft around which said developing roller is attached, said shaft extending longitudinally from a first end to a second end, said shaft rotatably held by the side plates of said case at said first and second ends;

two photosensitive drum retaining shafts, each of said shafts extending longitudinally from a first end to a second end, said shafts respectively fixed to said side plates at said first ends and respectively inserted into an interior of said photosensitive drum at said second ends; and supply roller, developing roller, and drum roller driving gears, said gears respectively fitted around said retaining shafts and thereby transmitting rotating forces to said supply roller, said developing roller, and said photosensitive drum while being rotated together;

said method comprising:

(1) providing driving gears for said unit such that the respective numbers of teeth of said supply roller, developing roller, and drum roller driving gears are not identical; and (2) equipping said unit with a removal-restricting means for allowing said supply roller retaining shaft and said developing roller retaining shaft to be combined with and removed from the side plates of said case only at a predetermined engagement state of said driving gears.

9. A method of preventing undesirable recycling of a developing unit of an image forming apparatus and undesirable supply of potentially inferior toner, said unit comprising:

a case comprising a body and side plates;

a supply roller, a developing roller, and a photosensitive roller housed in said case;

a supply roller retaining shaft around which said supply roller is attached, said shaft extending longitudinally from a first end to a second end, said shaft rotatably held by the side plates of said case at said first and second ends;

a developing roller retaining shaft around which said developing roller is attached, said shaft extending longitudinally from a first end to a second end, said shaft rotatably held by the side plates of said case at said first and second ends;

two photosensitive drum retaining shafts, each of said shafts extending longitudinally from a first end to a second end, said shafts respectively fixed to said side plates at said first ends and respectively inserted into an interior of said photosensitive drum at said second ends; and supply roller, developing roller, and drum roller driving gears, said gears respectively fitted around said retaining shafts and thereby transmitting rotating forces to said supply roller, said developing roller, and said photosensitive drum while being rotated together;

said method comprising:

(1) providing driving gears for said unit such that the respective numbers of teeth of said supply roller, developing roller, and drum roller driving gears are not identical; and (2) equipping said unit with a removal-restricting means for allowing said supply roller retaining shaft and said developing roller retaining shaft to be combined with and removed from the side plates of said case only at a predetermined engagement state of said driving gears, said removal-restricting means comprising:

removal restricting projections respectively formed on an end portion of said supply roller retaining shaft and on an end portion of said developing roller retaining shaft, and an accommodating means for receiving an end of said supply roller retaining shaft and an end of said developing roller retaining shaft.

10. The method of claim 9, wherein said accommodating means comprises engaging bosses formed on an one of said side plates of said case, said bosses having openings with shapes respectively corresponding to sectional shapes of said supply roller retaining shaft and said developing roller retaining shaft at positions where said removal restricting projections are formed.

11. The method of claim 9, wherein said removal restricting means further comprises, an additional removal restricting projection formed on an inner end portion of said photosensitive drum retaining shaft, and an opening being formed on one end surface of said photosensitive drum and said opening having a shape corresponding to a sectional shape of said photosensitive drum retaining shaft at a position where said additional removal restricting projection is formed.

12. The method of claim 11, wherein through holes corresponding to said removal restricting projections are formed on said driving gears, said through holes communicating with shaft holes of said driving gears in an alignment state of said through and shaft holes.

13. The method of claim 12, wherein each of said driving gears has a predetermined number of teeth, and the respective numbers of teeth of said driving gears differ from one another, thereby causing the development unit to be removable from the case without damage only in a position of a gear rotation cycle that corresponds to a least common multiple of the product of said numbers of teeth and to a multiple of said least common multiple.

* * * * *